US007694965B2

(12) United States Patent
Bruhn et al.

(10) Patent No.: US 7,694,965 B2
(45) Date of Patent: Apr. 13, 2010

(54) FEEDER SPEED

(75) Inventors: Victor Bruhn, Brush Prairie, WA (US); Angela Krauskopf, Camas, WA (US); Beverly Loh, Vancouver, WA (US); Jon Johnson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 325 days.

(21) Appl. No.: 11/712,854

(22) Filed: Feb. 28, 2007

(65) Prior Publication Data

US 2008/0203655 A1 Aug. 28, 2008

(51) Int. Cl.
*B65H 5/02* (2006.01)

(52) U.S. Cl. ..... 271/275; 101/248; 271/265.02; 271/276

(58) Field of Classification Search ..... 271/270, 271/275, 202, 265.01, 276; 101/248
See application file for complete search history.

(56) References Cited

U.S. PATENT DOCUMENTS

| | | | | |
|---|---|---|---|---|
| 6,112,655 | A * | 9/2000 | Suzuki et al. | 101/118 |
| 6,298,778 | B1 * | 10/2001 | Onodera et al. | 101/232 |
| 6,508,465 | B1 * | 1/2003 | Endo | 271/265.01 |
| 6,539,854 | B2 * | 4/2003 | Maeda et al. | 101/118 |
| 6,705,222 | B2 * | 3/2004 | Norman et al. | 101/248 |
| 6,715,751 | B2 * | 4/2004 | Henn | 271/82 |
| 7,478,806 | B2 * | 1/2009 | Buck et al. | 271/204 |
| 2002/0063381 | A1 * | 5/2002 | Henn | 271/226 |
| 2006/0255535 | A1 * | 11/2006 | Takano | 271/270 |

* cited by examiner

*Primary Examiner*—Kaitlin S Joerger

(57) ABSTRACT

A first position of a media is determined with respect to a surface. The surface is advanced and a second position of the media is determined with respect to the surface. The relative speed between the surface and a linear speed feed of the media is altered based on the first and second positions.

25 Claims, 7 Drawing Sheets

FEEDER SPEED

BACKGROUND

In some printing systems, a sheet feeder transfers print media to a moving surface, such as a drum. The drum carries the print media to a print station, where ink, toner, or another suitable colorant is transferred to the print media.

During the life of a printer, rollers, belts, or other mechanical assemblies may wear creating a speed mismatch between the drum and the sheet feeder. Changes in media type or environmental conditions that affect drive roller to media friction may also cause a speed mismatch between the drum and the sheet feeder. This speed mismatch may affect print quality, paper jam rates, or a margin between printed material and an edge of the media.

DESCRIPTION

In one embodiment of a printing system, a sheet of media is fed toward a drum conveyor by a sheet feeder. As the sheet advances towards the conveyor, a sensor determines a first position of the sheet with respect to the drum, for instance, the leading edge of the sheet. The sheet is deposited on the drum and remains on the drum for at least one revolution. During a subsequent revolution, the sensor determines a second position of the sheet with respect to the drum. The second position is compared to the first position and the amount the sheet has moved with respect to the surface of the drum is determined. The speed of the sheet feeder is altered based on the amount of the movement.

In another embodiment of a printing system, a sheet of media is fed toward a conveyor by a sheet feeder. As the sheet advances towards the conveyor, a sensor determines a first position of the sheet with respect to the conveyor, for instance, the leading edge of the sheet. The sheet is deposited on the conveyor; and as the sheet advances, the sensor determines a second position of the sheet with respect to the conveyor, for example the trailing edge of the sheet. If a length of the sheet is not known or not well controlled, a second sensor may be used to determine the length of the sheet. Combinations of the leading edge, the trailing edge, and the length of the sheet may be used to determine the amount the sheet has moved with respect to the surface of the conveyor. The speed of the sheet feeder is altered based on the amount of the movement.

In yet another embodiment of a printing system, a sheet of media is fed toward a conveyor by a sheet feeder. The conveyor may be a belt conveyor or a drum. As the sheet advances towards the conveyor, a sensor determines a first position of the sheet with respect to the conveyor, for instance, the leading edge of the sheet. The sheet is deposited on the conveyor, and as the sheet advances along the conveyor, a second sensor determines a second position of the sheet with respect to the conveyor, for example, the leading edge of the sheet. The two positions are compared with each other to determine the amount the sheet has moved with respect to the surface of the conveyor. The speed of the sheet feeder is altered based on the amount of the movement.

Figure 1:
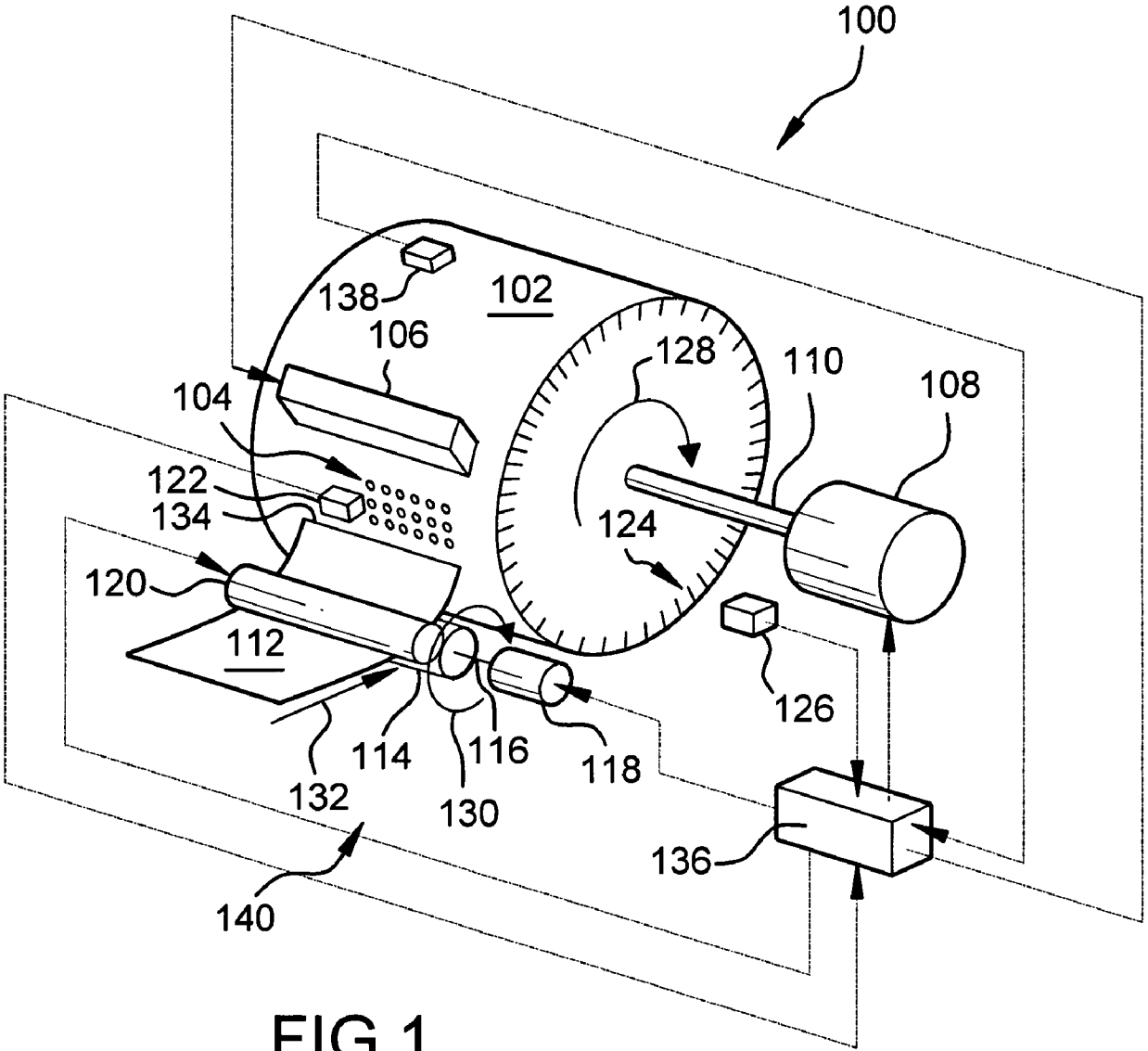
FIG. 1 shows a printing mechanism according to an embodiment of a printing system.

FIG. 1 shows a printing mechanism 100 according to an embodiment of a printing system. A sheet 112 of media is between a drive roller 114 and a pinch roller 120. The pinch roller 120 provides a force to hold the sheet 112 against the drive roller 114. A first drive motor 118 is coupled to the drive roller 114 by a first drive motor shaft 116. As the first drive motor 118 and the first drive motor shaft 116 rotate 130, friction between the drive roller 114 and the sheet 112 advances the sheet 112 towards a drum 102. The drive roller 114, is an embodiment of a sheet feeder 140. Other sheet feeders may alternately be employed.

The drum 102 has orifices 104 attached to a vacuum source (not shown). The vacuum holds the sheet 112 to the surface of the drum 102 after the sheet 112 has advanced in a direction 132 onto the drum 104. Electrostatic forces, other rollers, or the like, may alternatively or additionally be used to hold the sheet 112 to the drum 102.

A second drive motor 108 is coupled to the drum 102 by a second drive motor shaft 110. The second drive motor 108 and the second drive motor shaft 110 rotate 128 the drum 102 at a substantially constant speed.

A controller 136 controls the speed of the roller 114 via the first drive motor 118. Hence, the controller 136 controls a speed with which the sheet 112 advances towards and onto the drum 102. The speed of the first drive motor 118 is chosen such that the linear speed of the sheet 112 substantially matches the linear speed on the surface of the drum 102.

In another embodiment of a printing mechanism 100, the controller may control the speed of the drum 102. The drum speed may be adjusted such that the linear speed on the surface of the drum matches the linear speed of the sheet 112.

In yet another embodiment of a printing mechanism 100, the controller may alter a force on the pinch roller 120 to adjust the friction between the sheet 112 and the drive roller 114. When the force is high; the linear speed of the sheet 112 is relatively fast, when the force is low; the linear speed of the sheet is relatively slow.

A first sensor 122 is operatively coupled to a controller 136. The drive roller 114 advances the sheet 112 in a direction 132 towards the drum 102; the sheet meets the surface of the drum 112. As mentioned previously, the sheet 112 may be held to the drum 102 by vacuum or other methods. The first sensor 122 detects a leading edge 134 of the sheet 112 and transmits a signal to the controller 136 upon detecting the leading edge 134.

An encoder sensor 126 communicates the rotational position of the drum 102 to the controller 136 by an encoder 124 coupled to the drum 102. When the first sensor 122 detects the leading edge 134 of the sheet 112, the controller 136 uses the encoder sensor 126 to determine the rotational position of the drum 102 and hence the position of the sheet 112 with respect to the drum 102.

The rotating 128 drum 102 conveys the sheet 112 past a print head assembly 106. In some embodiments, the print head assembly 106 may be a page wide array of ink nozzles in an ink-jet printer. The first sensor 122 provides a top of form signal to the controller 136 so that the controller 136 can control the timing of the print head assembly 106 to print on the sheet 112. If the sheet 112 moves relative to the drum 102 when the print head assembly 106 is printing, printing defects may occur. Paper jams or alignment errors which occur between the print and the sheet 112 may cause margin variations.

A second sensor 138 is operatively coupled to the controller 136. The second sensor 138 is shown positioned near the top of the drum 102; although the second sensor 138 may be positioned in any of a variety of suitable locations around the drum 102. The second sensor 138 may be used with the controller 136 to determine a second position of the sheet 112 with respect to the drum 102 as described in reference to FIG. 2A. The second sensor 138 may also be used with the controller 136 to determine a length of the sheet 112 as described in reference to FIG. 3.

Figure 2A:
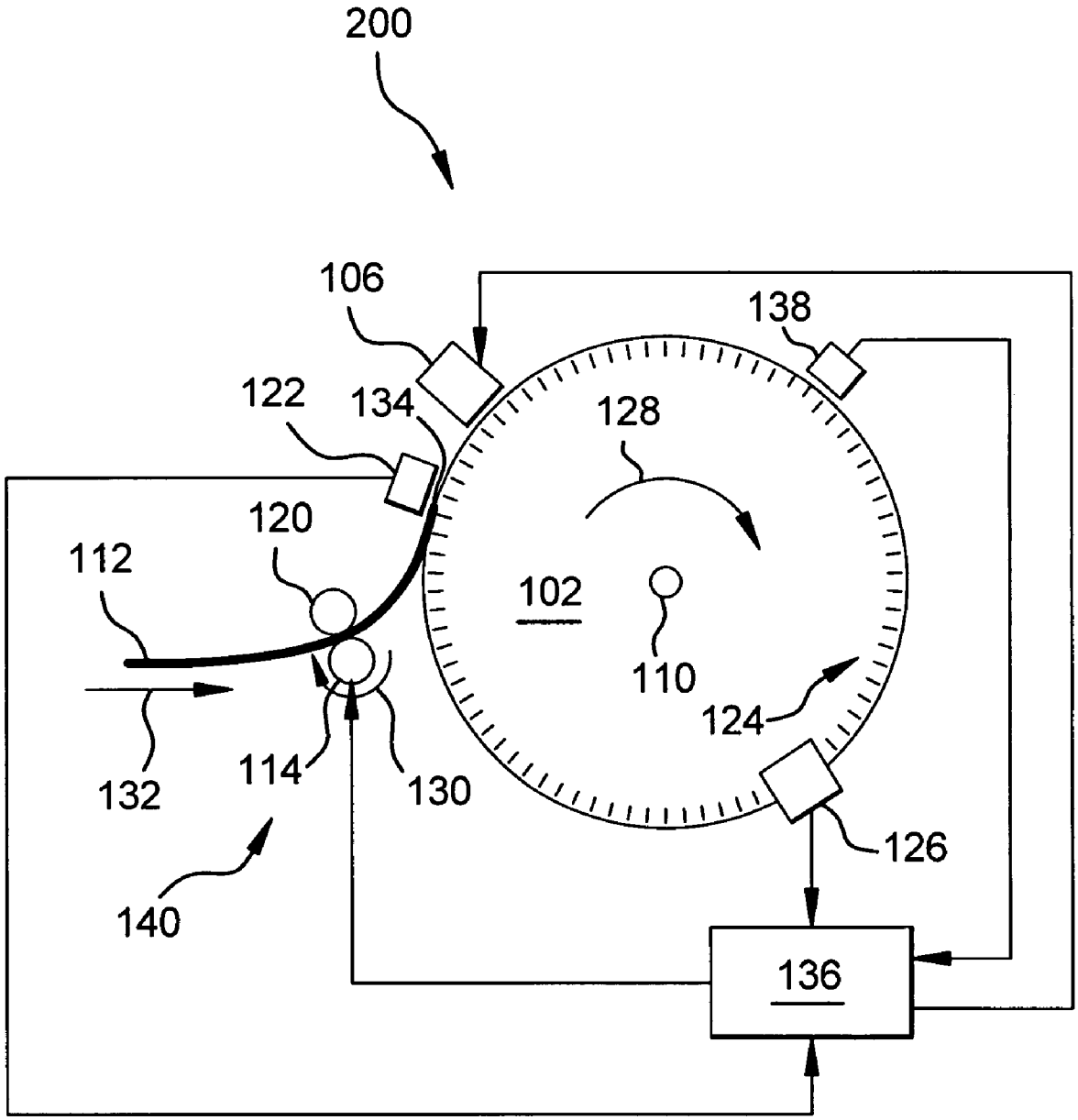
FIG. 2A illustrates an elevation view of FIG. 1 where a sheet of media is fed from a sheet feeder to a rotating drum according to an embodiment of a printing system.

FIG. 2A is an elevation view 200 of the printing mechanism 100 of FIG. 1 according to an embodiment of a printing system. A sheet 112 of media is fed from a sheet feeder 140 to a rotating drum 102. The drum 102 rotates in direction 128. As described in reference to FIG. 1, the sheet 112 is fed in a direction 132 toward the drum 102 by rotating a drive roller 114 in direction 130. A pinch roller 120 forces the sheet 112 against the drive roller 114. The speed of the sheet 112 is determined by the speed of the drive roller 114 which in turn is determined by a controller 136.

The drum 102 is rotated 128 at a substantially constant speed around a shaft 110. The speed of the drive roller 114 is chosen by the controller 136 so that the speed of the sheet 112 substantially matches the surface speed of the drum 102.

The controller 136 receives a signal from a first sensor 122 which detects the position of the sheet 112 as the sheet 112 passes under the first sensor 122. The position may be, but is not limited to, the leading edge 134 of the sheet 112. The first sensor 122 may also be configured to detect targets (not shown) which are included within or placed upon the sheet 112. Examples of targets are: a line near the top of the sheet 112, a hole through the sheet 112, or another fiducial placed on or in the sheet.

The controller 136 receives signals from an encoder sensor 126. The encoder sensor 126 reads an encoder 124. The encoder 124 is coupled to the drum 102. When the drum 102 rotates 128, the controller 136 receives positional information about the drum 102.

Since the controller 136 receives signals from both the first sensor 122, which detects the positional information of the sheet 112, and the encoder sensor 126, which provides rotational information about the drum 102; then the controller can determine a first position of a sheet 112 with respect to the drum 102.

The rotating 128 drum 102 conveys the sheet 112 under a print head assembly 106. The print head assembly 106 may be a page wide array of ink nozzles in an ink-jet printer. The first sensor 122 is used by the controller 136 to determine when the print head assembly 106 prints on the sheet 112. If the sheet 112 moves relative to the drum 102 when the print head assembly 106 is printing, print defects may occur. Paper jams or alignment errors may also occur.

In a similar manner as described in reference to the operation of the first sensor 122, the controller 136 receives signals from a second sensor 138. The second sensor 138 is configured to identify a second position of the sheet 112. As the sheet 112 rotates 128 under the second sensor 138, the second sensor 138 communicates with the controller 136 to identify the second position of the sheet 112 with respect to the drum 102. The second sensor 138 may detect the leading edge 134 of the sheet 112 or other marks such as targets, lines, fiducials or the like.

The first position of the sheet 112 with respect to the drum 102 is determined by the first sensor 122. The second position of the sheet 112 with respect to the drum 102 is determined by the second sensor 138. The controller 136 monitors the angular position of the drum by the encoder sensor 126. If the leading edge 134 of the sheet 112 arrives at the second sensor 138 before the drum 102 has rotated a predetermined number of encoder counts, then the sheet 112 is determined to have slipped forward past the drum 102. An average forward slippage may be calculated. Consequently, and in response to the average forward slippage, the controller 136 reduces the speed of rotation 130 of the drive roller 114 to decrease the speed for subsequent sheets 112 fed to the drum 102 to more closely match the speed of the drum 102. If the leading edge 134 of the sheet arrives at the second sensor 138 after the drum 102 has rotated 128 a predetermined number of encoder counts, then the sheet 112 is determined to have slipped backward with respect to the drum 102. An average backward slippage may be calculated. As a result of the average backward slippage, the controller 136 increases the speed of rotation 130 of the drive roller 114 to increase the speed of subsequent sheets 112 fed to the drum 102 to substantially match the speed of the drum 102.

Figure 2B:
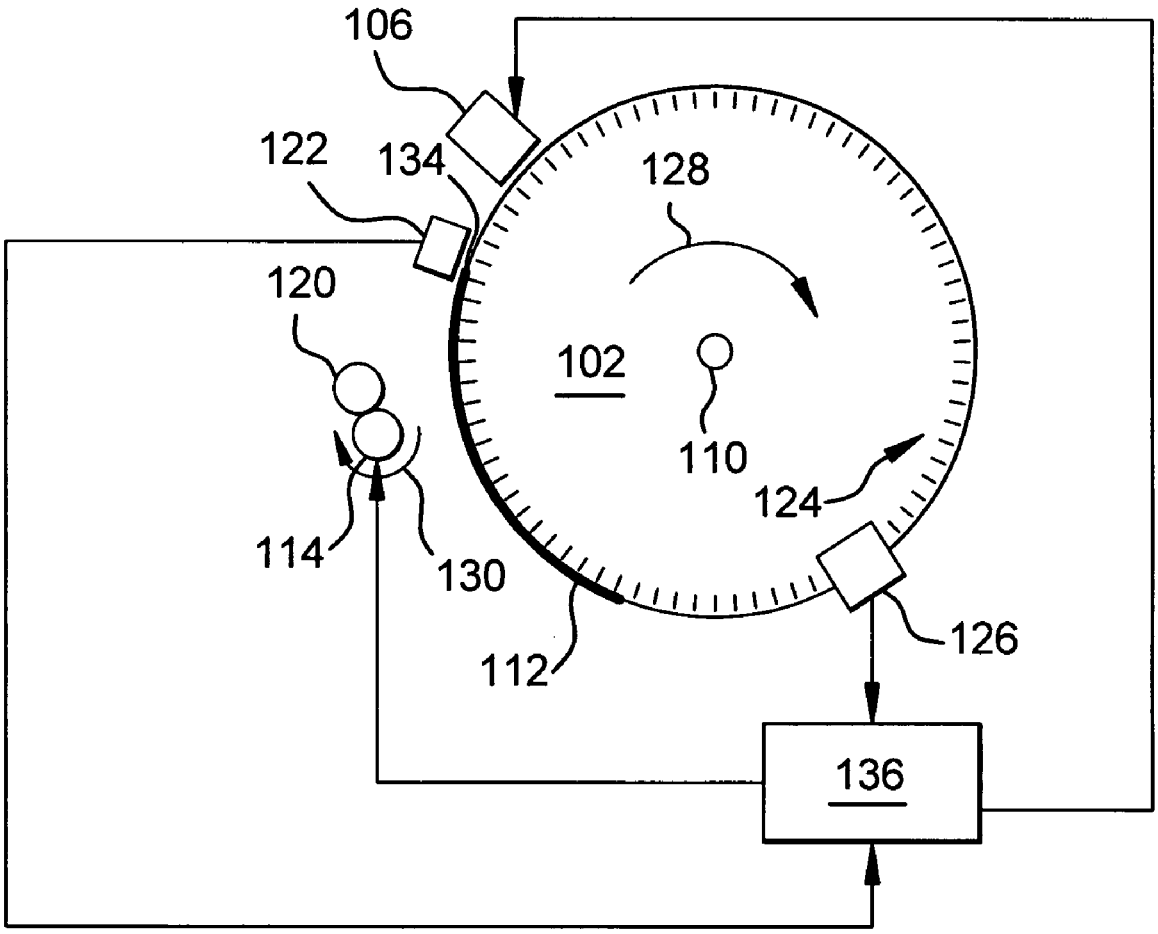
FIG. 2B shows an elevation view of FIG. 1 where the sheet of media in FIG. 2A completes one rotation on a drum according to an embodiment of a printing system.

FIG. 2B illustrates the mechanism 100 of FIG. 1 where the sheet 112 of media in FIG. 2A completes one rotation on a drum 102 according to an embodiment of a printing system. FIG. 2B is similar to FIG. 2A; although the sheet 112 of media is shown completing at least one revolution on the drum 102.

In FIG. 2A, the first position of the sheet 112 is determined by the first sensor 122 with respect to the drum 102 when the sheet 112 is loaded. When the first sensor 122 detects the leading edge 134 of the sheet 112, the controller 136 records the angular position of the drum 102 from an encoder sensor 126. The encoder sensor 126 determines the angular position of the drum 102 by reading an encoder 124 coupled to the drum 102. In FIG. 2B, the second position of the sheet 112 is determined by the first sensor 122 as the sheet is conveyed past the first sensor 122 a subsequent time as a result of rotating the drum 102 in direction 128.

In FIG. 2B, if the leading edge 134 of the sheet 112 arrives at the first sensor 122 before the drum 102 has rotated 128 a complete revolution, as determined by the number of encoder counts between instances of sensing the leading edge 134, is fewer than the total number of encoder counts when the drum 102 is rotated a complete revolution, then the sheet 112 is determined to have slipped forward past the drum 102. Consequently, the controller 136 slows the speed of rotation of the drive roller 114 to decrease the speed of subsequent sheets 112 fed to the drum 102 to substantially match the speed of the drum 102. If the leading edge 134 of the sheet arrives at the first sensor 122 after the drum 102 has rotated a complete revolution, then the sheet 112 is determined to have slipped backward with respect to the drum 102. As a result, the controller 136 increases the speed of rotation 130 of the drive roller 114 to increase the speed of subsequent sheets 112 fed to the drum 102 to substantially match the speed of the drum 102. A complete revolution of the drum 102 is used to describe an embodiment of a printing system; however, it is not necessary that the drum rotate a complete revolution. Fractional, multiple revolutions, or combinations of fractional and multiple revolutions may also be used.

Figure 3A:
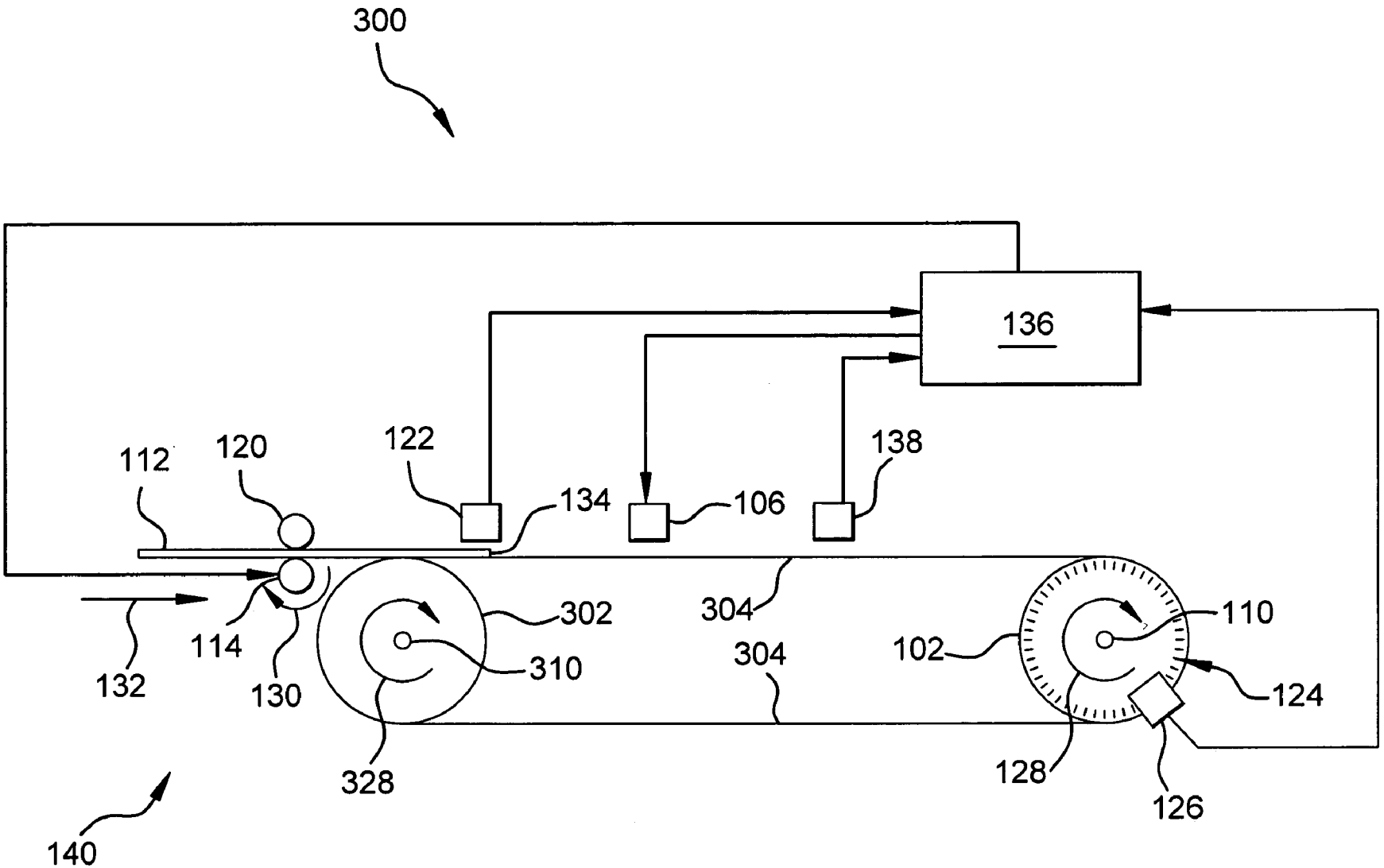
FIG. 3A illustrates a cross sectional view of a belt conveyor system where a sheet of media is fed onto a moving belt and the sheet is positioned near a first sensor according to an embodiment of a printing system.

FIG. 3A illustrates a belt conveyor system 300 where a sheet 112 of media is fed onto a moving belt 304 according to an embodiment of a printing system. The sheet 112 is positioned near a first sensor 122. The sheet 112 is fed from a sheet feeder 140 in a direction 132 toward a rotating 128 drum 102.

The belt 304 is supported on drums 102 and 302, which rotate in directions 128 and 328, around shafts 110 and 310, respectively. The belt 304 does not substantially slip with respect to drum 102. An encoder 124 is coupled to drum 102. An encoder sensor 126 sends positional signals to controller 136. The controller 136 determines the rotational position of the drum 102 and hence the linear position of the belt 304 from the encoder sensor 126 signals.

Drum 102 rotates at a substantially constant speed in direction 128. Likewise, by the connecting belt 304, drum 302 also rotates in direction 328 at a substantially constant speed. The surface velocity of the belt 304 is substantially constant.

The sheet feeder 140 feeds one sheet 112 of media at a time onto the belt 304. The sheet 112 may be held in place by vacuum, electrostatic force, rollers, or the like. To reduce print quality, jam rate, or margin issues, the controller 136 adjusts the speed of the sheet 112 leaving the sheet feeder 140 to substantially match the speed of the belt 304 so that the sheet 112 does not slip significantly with respect to the belt 304. As the sheet 112 passes under the print head assembly 106 (see FIG. 3B), the print head assembly prints on the sheet 112. However, if the sheet 112 slips with respect to the belt 304, print defects may occur. Alignment errors between the print and the sheet may also occur. Paper jams may also occur. The speed of the sheet 112 is determined by the rotational speed of the drive roller 114. The speed of the drive roller 114 is controlled by the controller 136.

The leading edge 134 of the sheet 112 is detected by the first sensor 122. The first sensor 122 sends signals to the controller 136. The first sensor 122 and the controller 136 determine a first position of the media with respect to a surface, for instance, the sheet 112 of media with respect to the surface of the belt 304. The first sensor 122 also signals the controller 136 to activate the print head assembly 106 at an appropriate time so that the print is aligned to the sheet 112.

Figure 3B:
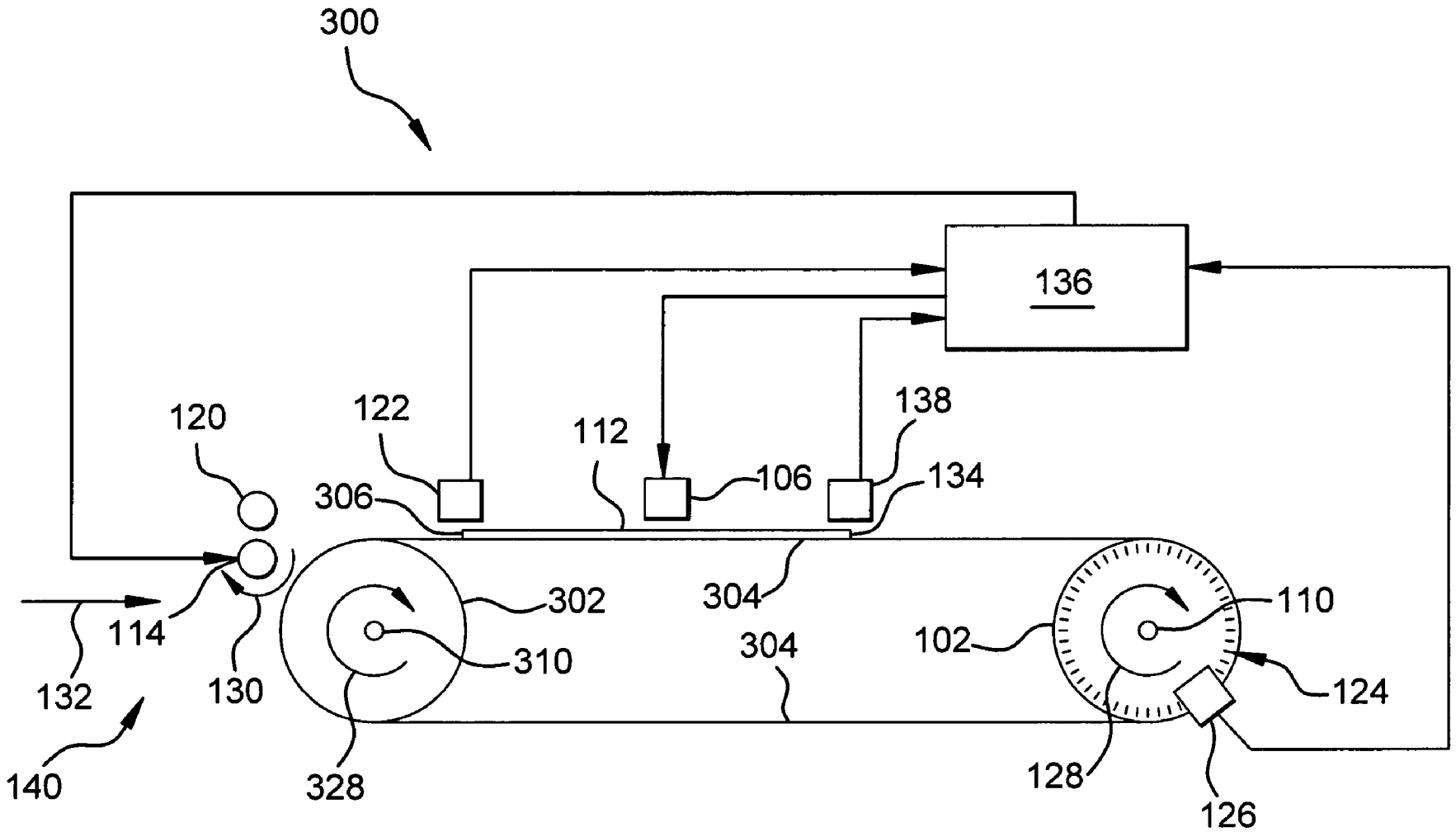
FIG. 3B shows a cross sectional view of the belt conveyor where the sheet of media on the surface of the belt in FIG. 3A is advanced, such that the sheet is under a pair of sensors according to an embodiment of a printing system.

FIG. 3B shows a cross sectional view of the belt conveyor system 300 according to an embodiment of a printing system. The sheet 112 of media on the surface of the belt 304 is advanced from the position shown in FIG. 3A such that the sheet 112 is under a pair of sensors 122 and 138. As the sheet 112 continues to advance in the direction 132 towards the drum 102, the first sensor 122 detects the trailing edge 306 of the sheet 112. The trailing edge 306 of the sheet 112, along with the encoder sensor 126 and the controller 136 determines a second position of the sheet 112 with respect to the belt 304. If the length of the sheet 112 is known; and if the trailing edge 304 of the sheet 112 arrives at the first sensor 122 before the belt has advanced in the direction 132 toward the drum 102 a predetermined distance, then the sheet 112 is determined to have slipped forward with respect to the belt 304. Consequently, the controller 136 may slow the speed of rotation 130 of the drive roller 114 to decrease the speed of subsequent sheets 112 fed to the belt 304 to substantially match the speed of the belt 304. If the trailing edge 306 of the sheet 112 arrives at the first sensor 122 after the belt 304 has advanced a predetermined distance, then the sheet 112 is determined to have slipped backward with respect to the belt 306. Consequently, the controller 136 may increase the speed of rotation 130 of the drive roller 114 to increase the speed of subsequent sheets 112 fed to the belt 304 to substantially match the speed of the belt 304.

If the length of the sheet 112 is not known, well controlled, or if a series of sheets are of variable length, a second sensor 138 can be used to determine the length of the sheet 112 as follows. When the sheet is completely loaded onto the belt 304, the sheet 112 does not slip with respect to the belt 304. The second sensor 138 determines the leading edge 134 of the sheet 112. As the belt advances in a direction 132 towards the drum 102 at a constant velocity, the trailing edge 306 of the sheet 306 passes the second sensor 138. The length of the sheet 112 is calculated by the controller 136 based on: the signal from the leading edge 134 of the second sensor 138, the signal from the trailing edge 306 of the second sensor 138, and signals from the encoder sensor 126. As shown in FIGS. 1 and 2A, the length of the sheet 112 may also be determined by the controller 136 receiving signals from the leading and trailing edge of the sheet 112 passing the second sensor 138 and the controller 136 receiving signals from the encoder sensor 126.

Figure 4:
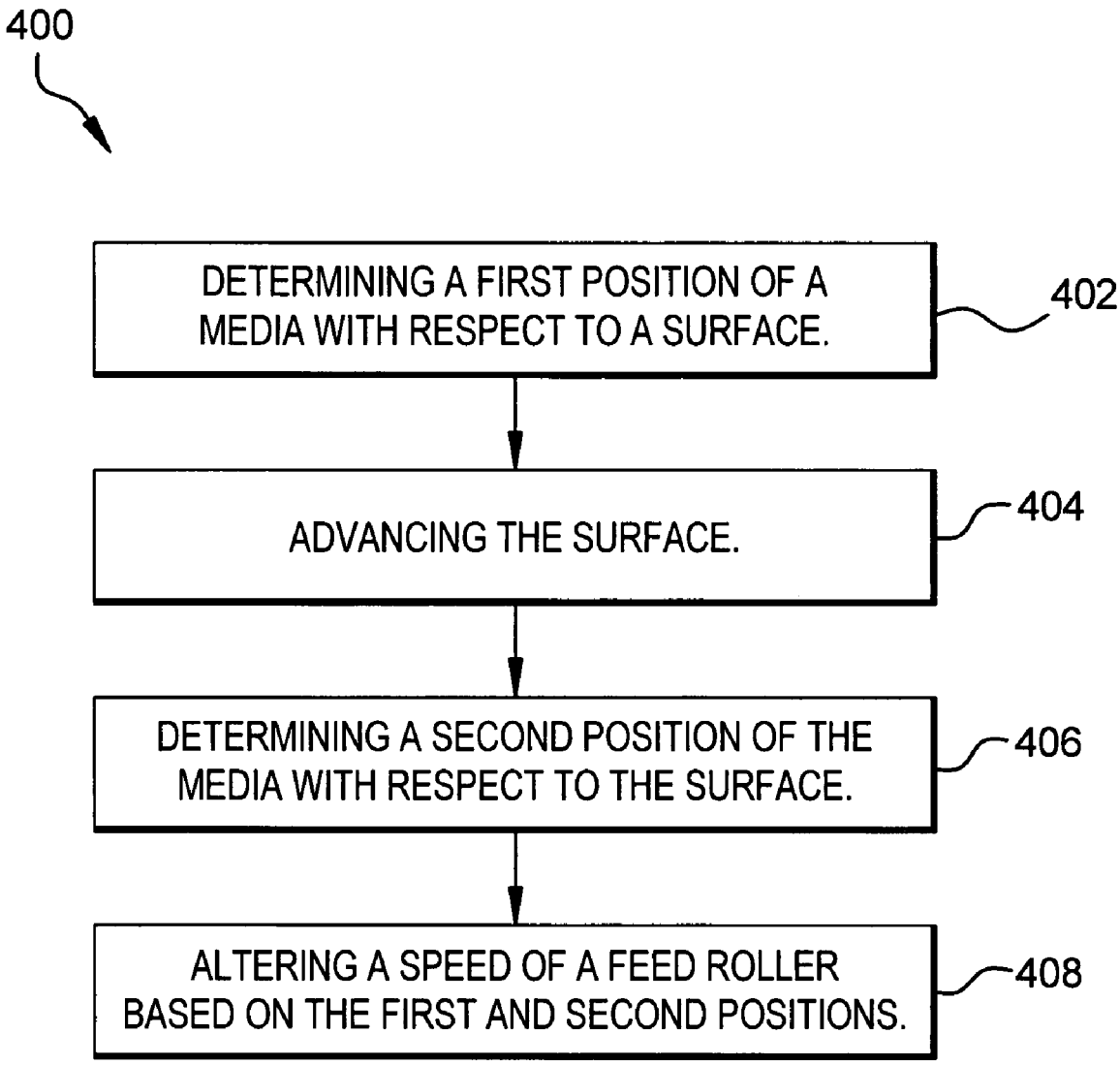
FIG. 4 is a flowchart for adjusting a speed of a sheet feeder to substantially match a speed of a media conveyor according to an embodiment of a printing system.

FIG. 4 illustrates flowchart 400 for adjusting a speed of a sheet feeder to substantially match a speed of a media conveyor according to an embodiment of a printing system.

At block 402 a controller, such as the controller 136 (FIG. 1), determines a first position of a media with respect to a surface as shown in reference to FIGS. 1, 2A, and 3A. A first sensor 122 detects the location of a sheet 112 of media on a surface as the sheet 112 of media passes by the first sensor 122. The position of the sheet 112 of media on the surface, such as the surface of a drum 102 or a belt 304 is determined by the first sensor 122 detecting a location on the sheet 112, and the encoder sensor 126 sending the encoder count signals to the controller 136 that correspond with the location on the sheet 112 on the drum 102. The location on the sheet may be the leading edge 134 of the sheet 112. The encoder sensor 126 monitors the rotation of the drum 102. The outputs of the first sensor 122 and the encoder sensor 126 are input to a controller 136 which determines the first position of the media with respect to the surface based on these outputs.

At block 404 the surface carrying the sheet 112 advances the sheet 112. In FIGS. 1, 2A, 2B, 3A and 3B, the surface, for example, the surface of the drum 102 or the belt 304 is advanced by rotating the drum 102.

At block 406 a controller, such as the controller 136 (FIG. 1), determines a second position of the media with respect to the surface as shown in reference to FIGS. 2A, 2B and 3B. In FIG. 2A, a second sensor 138 may be used to detect a position of the sheet 112 of media with respect to the drum 102. In FIG. 2B, a first sensor 122 may be used to detect a position of the sheet 112 of media with respect to the drum 102 after the sheet 112 of media rotates a complete revolution. In FIG. 3B, a first sensor 122 may be used to detect the trailing edge 306 of the sheet 112 of media with respect to the belt 304.

At block 408 a controller, such as the controller 136 (FIG. 1) alters a speed of a feed roller based on the first and second positions. In FIGS. 1, 2A, 2B, and 3B, a controller 136 compares the first position with the second position. If the second position, such as the leading edge 134 of the sheet 112 of media is behind the first position, then the media is determined to have slipped backward with respect to the drum 102 or belt 304. As a result, the controller 136 may command the drive roller 114 to speed up. If the second position is ahead of the first position, then the media is determined to have advanced forward with respect to the drum 102 or belt 304. Consequently, the controller 136 may command the drive roller 114 to slow down.

Figure 5:
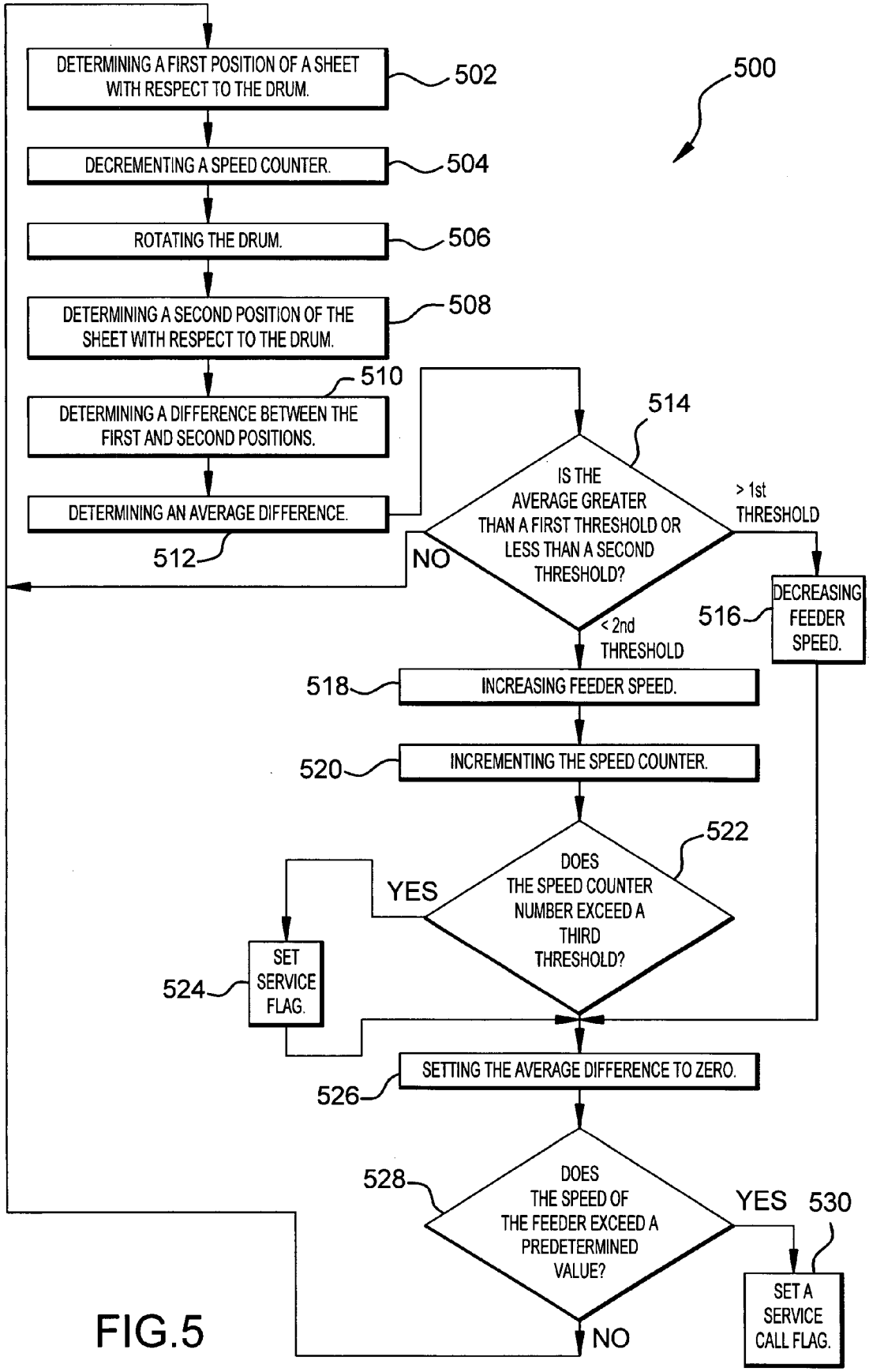
FIG. 5 is a flowchart for adjusting the speed of the sheet feeder to substantially match the speed of the media conveyor.

FIG. 5 shows a flowchart 500 for adjusting the speed of a sheet feeder to substantially match a speed of the media conveyor.

At block 502 a controller 136 determines a first position of a sheet 112 with respect to a drum 102 as shown in reference to FIGS. 1 and 2A and described above.

At block 504 the controller 136 decrements a speed counter. The speed counter may be within the controller 136 (see FIGS. 1, 2A, 2B, 3A, and 3B) and may include a memory, a register, a hardware counter, or the like. The speed counter is initialized to zero. The speed counter is decremented when a sheet 112 is loaded onto the drum 102; however, the speed counter is not decremented below zero. The speed counter may be decremented a relatively small amount such as a value of 1.

The value of the speed counter is incremented when the controller 136 increases the speed of the drive roller 114. The speed counter may be incremented by a relatively large amount, such as a value of 50, when the controller 136 increases the speed of the drive roller 114

At block 506 the drum 102 rotates (see FIG. 1). The drum rotates at a substantially constant angular velocity such that the velocity at the surface of the drum 102 is substantially constant. In some embodiments, the drum 102 rotates at a substantially constant speed through execution of the entire flowchart 500.

At block 508 the controller determines a second position of a sheet 112 with respect to a drum 102 as shown in reference to FIG. 2A. The second position of the sheet 112 may be determined as described above.

At block 510 the controller determines a difference (D0) between the first and the second positions. The controller 136 (see FIG. 2A) calculates the difference (D0) between the first rotational position of the drum 102 when the leading edge 134 of the sheet 112 passes the first sensor 122 and the second rotational position (see FIG. 2B) of the drum 102 when the leading edge 134 of the sheet passes the first sensor of the drum 102 on a second or subsequent pass.

At block 512, the controller determines an average difference $D_{new}$ in accord with the following equation: $D_{new}=\frac{1}{5}(4D_{old}+D0)$. The old value of the difference ($D_{old}$) is initially the difference (D0). The new value of the average difference ($D_{new}$) is a weighted average of four times the old value $D_{old}$ of the difference plus the difference (D0). When subsequent differences (D0) are calculated, as in block 510, then the old value of the average difference ($D_{old}$) is assigned the previous value of the new value of the average difference $D_{new}$. The weighting factors of 4 times $D_{old}$ and 1 times D0 may be satisfactory in some embodiments. Other weighting factors may be used in other embodiments depending on the type of printer, type of feeder, and type of media. In other embodiments, the average difference may be an unweighted mathematical mean of prior difference calculations.

At block 514, the controller determines whether the average difference $D_{new}$ is greater than a first threshold or less than a second threshold, or neither. If Act 514 is neither greater than a first threshold nor less than a second threshold, then execution proceeds to block 502. If the average difference $D_{new}$ is greater than a first threshold, then execution proceeds to block 516. If the average difference $D_{new}$ is less than a second threshold, then execution proceeds to block 518.

At block 516, the controller decreases the sheet feeder 140 speed (see FIGS. 1 and 2A). In some embodiments, the controller decreases the sheet feeder speed by reducing the speed of a motor or a feed roller. The first threshold is a threshold established that, if exceeded, will trigger a motor speed decrease.

At block 518 the controller increases the sheet feeder 140 speed (see FIGS. 1 and 2A). In some embodiments, the controller increases the sheet feeder speed by increasing the speed of a motor or feed roller. The second threshold is a threshold established that, if fallen below, will trigger a motor speed increase.

At block 520, the controller 136 increments the speed counter. This counter can be used as a monitor for sheet feeder or drum problems. The speed counter may be incremented by a relatively large value, such as 50, when the controller 136 increases the speed of the drive roller 114.

At block 522, the controller determines whether the speed counter exceeds a third threshold—a predetermined threshold for an excessive number of speed increases. If the third threshold is exceeded, then the controller sets a service flag to indicate that a large number of speed increases occurred. The service flag may be a register set in the controller 136 which can be communicated to a user or a service person.

At block 526, the controller sets the average difference values $D_{new}$ and $D_{old}$ to zero if either the sheet feeder speed is increased or decreased. Setting the average difference to zero may reduce the chance that multiple speed increases or decreases will occur in consecutive drum revolutions.

At block 528 the controller determines whether the speed of the sheet feeder exceeds a predetermined value. The predetermined value may be established for the greatest speed anticipated for the sheet feeder. If the speed of the sheet feeder exceeds the predetermined value, then the controller sets a service call flag at block 530, else execution returns to block 502 and the cycle repeats.

While the present embodiments of a printing system have been particularly shown and described, those skilled in the art will understand that many variations may be made therein without departing from the spirit and scope of the embodiments defined in the following claims. The description of the embodiment is understood to include all novel and non-obvious combinations of elements described herein, and claims may be presented in this or a later application to any novel and non-obvious combination of these elements. The foregoing embodiments are illustrative, and no single feature or element would have to be included in all possible combinations that may be claimed in this or a later application. Where the claims recite "a" or "a first" element of the equivalent thereof, such claims should be understood to include incorporation of one or more such elements, neither specifically including nor excluding two or more such elements. Although exemplary embodiments of a printing system have been described, the application is not limited and may include a photocopier, a facsimile machine, or the like.

What is claimed is:

1. A method, comprising:

determining a first position of a sheet with respect to a drum;

rotating the drum;

determining a second position of the sheet with respect to the drum; and altering a relative speed between a feeder and the drum based on the first and second positions.

2. The method of claim 1, wherein rotating the drum includes rotating the drum at a substantially constant speed.

3. The method of claim 1, wherein determining the first position of the sheet comprises determining a location of a leading edge of the sheet.

4. The method of claim 1, wherein the feeder is configured to advance the sheet towards the drum.

5. The method of claim 1, wherein the determining the first and second positions of the sheet with respect to the drum are performed by a common sensor.

6. The method of claim 1, further comprising determining a difference between the first and the second positions of the sheet with respect to the drum.

7. The method of claim 1, further comprising determining an average difference between a previously measured difference between the first and the second positions of the sheet with respect to the drum, and a currently measured difference between the first and the second positions of the sheet with respect to the drum.

8. The method of claim 1, further comprising determining a weighted average difference between a previously measured difference between the first and the second positions of the sheet with respect to the drum, and a currently measured difference between the first and the second positions of the sheet with respect to the drum.

9. The method of claim 1, wherein the speed of the feeder is increased if a weighted average difference between a previously measured difference between the first and second positions of the sheet with respect to the drum and a currently measured difference between the first and the second position of the sheet with respect to the drum is below a first threshold.

10. The method of claim 1, further comprising incrementing a speed counter each time the speed of the feeder is increased.

11. The method of claim 1, further comprising incrementing a speed counter each time the speed of the feeder is increased and setting a service flag if the speed counter number exceeds a third threshold.

12. The method of claim 1, further comprising determining a weighted average difference between a previously measured difference between the first and the second position of the sheet with respect to the drum and a currently measured difference between the first and the second positions of the sheet with respect to the drum, and wherein the speed of the feeder is decreased if the average difference is above a second threshold.

13. The method of claim 1, further comprising setting a service call flag if the speed of the feeder exceeds a predetermined speed value.

14. A method, comprising:

determining a first position of a media with respect to a surface;

advancing the surface;

determining a second position of the media with respect to the surface; and altering a relative speed between the surface and a linear speed feed of the media based on the first and second positions.

15. The method of claim 14, wherein the determining the first position of the media comprises sensing a leading edge of the media and determining the second position of the media comprises sensing a trailing edge of the media.

16. The method of claim 14, wherein the altering a relative speed between the surface and a linear speed feed of the media includes altering a force on a pinch roller.

17. An apparatus, comprising:

a drum configured to receive a sheet from a feeder;

one or more sensors for determining first and second positions of the sheet with respect to the drum; and a controller configured to alter the speed of the feeder based on the first and the second positions.

18. The apparatus of claim 17, further comprising a print engine, the print engine configured to form an image on the sheet.

19. The apparatus in claim 17, wherein the controller is further configured to calculate a difference between the first position and the second position of the sheet with respect to the drum.

20. The apparatus in claim 17, wherein the controller is configured to adjust the speed of the feeder based on a difference between the first and the second positions.

21. The apparatus in claim 17, wherein the controller is configured to average a difference between the first position and the second position of the sheet.

22. The apparatus in claim 17, where the controller increments a speed counter each time the speed of the feeder is increased.

23. The apparatus in claim 17, where the controller decrements a speed counter each time the sheet is fed to the drum.

24. The apparatus in claim 17, wherein the controller increments a speed counter each time the speed of the feeder is increased and sets a service call flag if the number of speed up commands exceeds a speed count threshold.

25. The apparatus in claim 17, wherein the controller sets a service call flag if the feeder is commanded to speed up beyond a predetermined speed value.

* * * * *